US011039965B2

(12) United States Patent
Rowland et al.

(10) Patent No.: US 11,039,965 B2
(45) Date of Patent: Jun. 22, 2021

(54) HANDLES FOR A PATIENT CONVEYANCE APPARATUS

(71) Applicant: MODSEL PTY LTD., Maryborough (AU)

(72) Inventors: Lester Rowland, Maryborough (AU); Mark Gilroy, Bardon (AU)

(73) Assignee: MODSEL PTY LTD., Maryborough (AU)

( * ) Notice: Subject to any disclaimer, the term of this patent is extended or adjusted under 35 U.S.C. 154(b) by 95 days.

(21) Appl. No.: 16/598,150

(22) Filed: Oct. 10, 2019

(65) Prior Publication Data

US 2020/0113752 A1 Apr. 16, 2020

(51) Int. Cl.

| | |
|---|---|
| ***A61G 1/048*** | (2006.01) |
| ***A61G 1/017*** | (2006.01) |
| ***A61G 5/10*** | (2006.01) |
| ***A61G 1/02*** | (2006.01) |

(52) U.S. Cl.

CPC ..... *A61G 1/048* (2013.01); *A61G 1/017* (2013.01); *A61G 1/02* (2013.01); *A61G 5/1067* (2013.01)

(58) Field of Classification Search

CPC ..... A61G 1/017; A61G 1/048
USPC ..... 5/625, 626, 627; 297/183.2
See application file for complete search history.

(56) References Cited

U.S. PATENT DOCUMENTS 3,876,024 A * 4/1975 Shieman ..... A61G 7/08 180/19.1
4,724,555 A * 2/1988 Poehner ..... A61G 7/0506 5/183
5,069,465 A * 12/1991 Stryker ..... A61G 1/048 280/47.371
5,388,294 A * 2/1995 Reeder ..... A61G 7/05 280/47.371
5,806,111 A * 9/1998 Heimbrock ..... A61G 1/0225 280/47.371
6,240,583 B1 * 6/2001 Brooke ..... A61G 7/012 5/430
6,330,926 B1 * 12/2001 Heimbrock ..... A61G 7/018 180/65.1
7,039,971 B2 * 5/2006 Sebastien ..... A61G 7/053 5/430
7,996,939 B2 * 8/2011 Benedict ..... A61G 1/0262 5/611
10,869,791 B2 * 12/2020 Matheny ..... A61G 5/10
2006/0225212 A1 * 10/2006 Parson ..... A61G 5/14 5/618

(Continued)

FOREIGN PATENT DOCUMENTS

CA 2817690 A1 * 5/2012 ..... A61G 1/042
CA 2936677 A1 * 7/2015 ..... F16M 13/022
DE 102006011852 B3 * 6/2007 ..... A61G 1/0212

(Continued)

*Primary Examiner* — Michael Safavi

(74) *Attorney, Agent, or Firm* — Bond Schoeneck & King, PLLC; George McGuire

(57) ABSTRACT

A patient conveyance apparatus such as a transport chair or a stretcher is disclosed. The apparatus has a frame onto which a patient support with a lowering backrest is provided. The apparatus has two handles extending away from the frame. The handles are rotatable about two axes to change their position, and can be moved through different operative and stowed positions without conflicting with movement of backrest.

13 Claims, 4 Drawing Sheets

(56) References Cited

U.S. PATENT DOCUMENTS

| | | | | |
|---|---|---|---|---|
| 2007/0000057 | A1* | 1/2007 | Ward | A61G 1/0218 5/611 |
| 2020/0000655 | A1* | 1/2020 | Brubaker | A61G 1/02 |

FOREIGN PATENT DOCUMENTS

| | | | | | |
|---|---|---|---|---|---|
| EP | 2389914 | A1 | * | 11/2011 | A61G 5/1054 |
| EP | 3108865 | A1 | * | 12/2016 | A61G 7/0516 |
| GB | 2382994 | A | * | 6/2003 | A61G 1/013 |
| WO | WO-0239944 | A2 | * | 5/2002 | A61G 1/0562 |
| WO | WO-2007028883 | A2 | * | 3/2007 | A61G 1/048 |
| WO | WO-2012064942 | A2 | * | 5/2012 | A61G 1/04 |
| WO | WO-2015106232 | A1 | * | 7/2015 | A61G 13/101 |
| WO | WO-2017059830 | A1 | * | 4/2017 | A61G 1/048 |

* cited by examiner

HANDLES FOR A PATIENT CONVEYANCE APPARATUS

CROSS-REFERENCE TO RELATED APPLICATION

The present application relates and claims priority to Australian Patent Application No. 2018903841, filed Oct. 11, 2018, the entirety of which is hereby incorporated by reference.

FIELD OF THE INVENTION

The present invention relates to patient conveyance apparatus such as stretchers and transport chairs.

BACKGROUND TO THE INVENTION

In hospitals and other medical facilities it is frequently necessary to move patients around the facility. In many situations, it is difficult to move the patient even to a conveyance apparatus, such as from a bed to a wheelchair. In such situations, it is desirable to have a patient conveyance apparatus such as a stretcher or a transport chair in which the patient can be readily moved around the facility and in which they can stay for other purposes, such as for a medical examination or procedure.

It is further desirable to have such a wheeled patient conveyance apparatus which is readily adjustable for a patient, for instance between an upright or seated position and a reclined position.

It is also desirable for the wheeled patient conveyance apparatus to have handles which can be used to guide and to propel the patient conveyance. It is preferred that these handles are located behind the patient, as is typical in a wheelchair. This presents a problem, in that such handles are typically mounted to a backrest. If the backrest can be reclined, the handles would then be unusable. Locating and positioning handles which allow for the adjustment of the apparatus between an upright and a reclined position is difficult.

The provision of handles on a patient conveyance apparatus raises further difficulties. When the handles are mounted to the backrest, any pushing and pulling forces applied to the handles are transmitted via the backrest to the patient, potentially causing discomfort. Handles must be able to be easily used by medical staff of different heights and builds, meaning that they should preferably be adjustable. Handles must be readily available for use, but also should not prevent an impediment to a medical practitioner conducting an examination or procedure.

The present invention has been created in light of these problems and desiderata. Further advantages will be apparent from the following description.

SUMMARY OF THE INVENTION

According to one aspect of the present invention there is provided a patient conveyance apparatus having a frame, the patient conveyance apparatus having an elongate direction and a transverse direction;

the frame supporting a patient carrying portion, the patient carrying portion including a backrest which is moveable between a generally upright raised position and a relatively reclined lowered position;

the frame including a first arm mounting from which a first arm extends and a second arm mounting from which a second arm extends, each of the first arm and the second arm having an outer handle;

each of the first arm and the second arm being movable relative to the frame about a first axis and about a second axis, the first axis being oriented in the transverse direction, the second axis being generally perpendicular to the first axis, each of the first arm and the second arm being moveable between a stowed position in which the arm is located beneath the backrest and an operative position in which the arm extends to the rear of the backrest, each of the first arm and the second arm being moveable between its stowed position and its operative position when the backrest is in either its raised position or its lowered position.

It is preferred that each arm mounting includes a locking mechanism arranged to move between a locked configuration whereby the arm is fixed in a desired operative position and an unlocked configuration whereby the arm is free to move.

It is also preferred that movement of each arm is restricted by friction within the respective arm mounting.

It is preferred that each arm is located outside the backrest when in its operative position, whereby the backrest can be moved between its upright position and its lowered position while the arms are in their operative position.

Each arm mounting preferably includes a housing which defines a substantially cylindrical bearing having an axis oriented in the transverse direction, and an internal arm support arranged to rotate within the housing.

The housing may include a first internal projection, with the internal arm support having a catch arranged to engage with the internal projection when the arm is in its operative position. In a preferred embodiment, the catch includes a release arm which extends, in use, outside the housing.

The housing may include a second internal projection, with the internal arm support having an arcuate slot arranged to locate about the second internal projection, the second internal projection arranged to limit rotation of the internal arm support relative to the housing.

In a preferred embodiment, the arcuate slot extends through about 45°.

The internal arm support may include an outer projection to which an arm is mounted. The outer projection is preferably located on an internal shaft, arranged to rotate relative to the internal arm support about an axis perpendicular to the axis of the housing.

The patient conveyance apparatus may be a transport chair. Alternatively, the patient conveyance may be a stretcher.

BRIEF DESCRIPTION OF THE DRAWINGS

It will be convenient to further describe the invention with reference to preferred embodiments of the present invention. Other embodiments are possible, and consequently the particularity of the following discussion is not to be understood as superseding the generality of the preceding description of the invention. In the drawings.

DETAILED DESCRIPTION OF PREFERRED EMBODIMENTS

Figure 1:
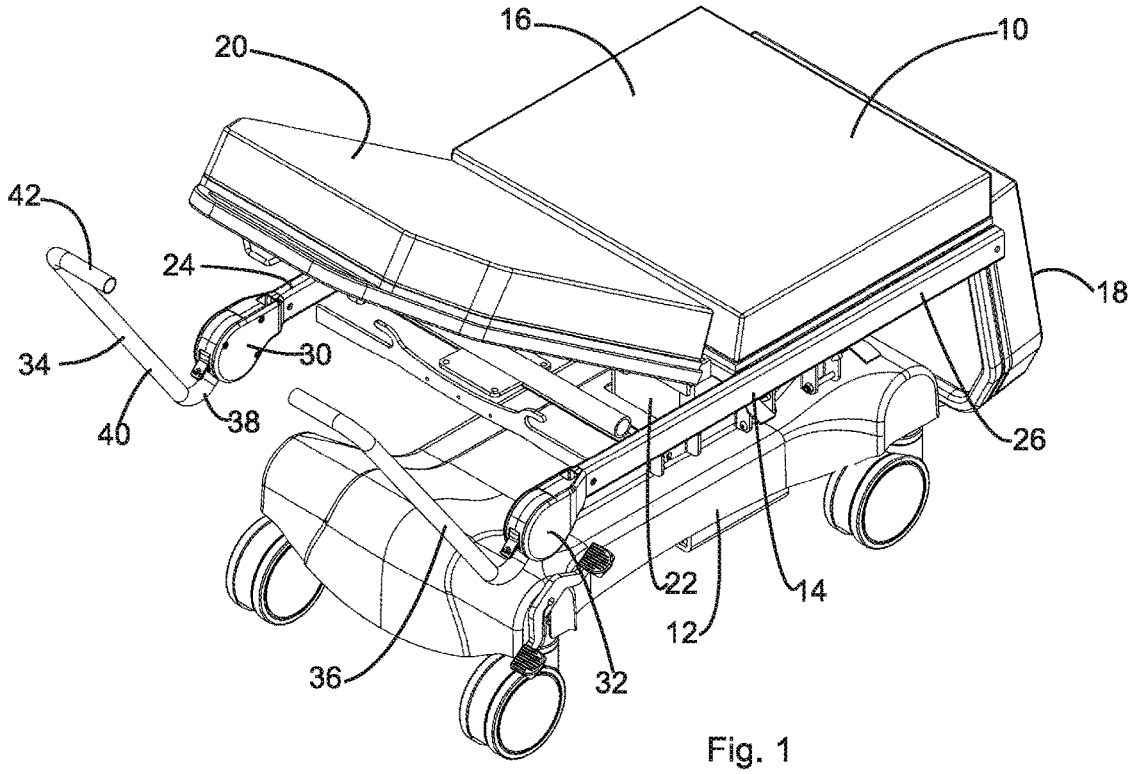
FIG. 1 is a perspective of a patient transport chair in accordance with the present invention, having two arms, each in a first operative position.

Referring to the Figures, there is shown a patient transport chair 10 having a wheeled undercarriage 12, a supporting frame 14, and a patient carrying portion having a seat 16, a leg rest 18 and a backrest 20.

In this embodiment, the supporting frame 14 is connected to the wheeled undercarriage 12 by a supporting column 22. In another embodiment (not shown), the supporting frame 14 is connected to the wheeled undercarriage by two supporting columns.

The supporting frame 14 has a first side rail 24 and a second side rail 26. The side rails 24, 26 extend in an elongate direction from a forward position at a front end of the seat 16 to a rear position beneath the backrest 20.

The supporting frame 14 has a first arm mounting 30 mounted to the rear of the first side rail 24, and a second arm mounting 32 mounted to the rear of the second side rail 26.

A first arm 34 extends from the first arm mounting 30, and a second arm 36 extends from the second arm mounting 32.

Each of the first and second arms 34, 36 has three portions: an inner portion 38 which extends from the respective arm mounting 30, 32; an extension portion 40 which extends away from the inner portion 38 at a 90° angle, and a handle 42 which extends away from an outer end of the extension portion 40 at a 90° angle. The handle 42 is perpendicular to the inner portion 38.

The first arm mounting 30 will now be described with reference to FIGS. 6 to 8. It will be appreciated that the first arm mounting 30 is essentially identical to the second arm mounting 32.

The first arm mounting 30 has an outer housing 50. The outer housing 50 has a connection portion 52 which is arranged to mount to the first side rail 24, and a main portion 54 which defines a substantially cylindrical bearing 56 covered at both axial ends by caps 58. The main portion 54 is arranged such that the bearing 56 has an axis oriented in a transverse direction relative to the first arm 34; that is, oriented towards the second arm mounting 32.

A generally cylindrical body portion 60 is located within the outer housing 50, arranged to rotate within the cylindrical bearing 56. The body portion 60 constitutes an internal arm support for the first arm 34.

The body portion 60 includes a diametrically aligned bore 62 arranged to support a rotating shaft 64. The rotating shaft 64 extends through a side wall of the outer housing 50 to form an outer projection 66. The arrangement is such that the inner portion 38 of the first arm 34 can be fixed to, and be aligned with, the outer projection 66. The rotating shaft 64 fits snugly within the bore 62, with friction restricting but not preventing rotation of the shaft 64.

The rotating shaft 64 includes an axially aligned cavity 68 extending inwardly from the outer protection 66, the axially aligned cavity being arranged to allow electrical control wiring 70 to pass internally of the housing 50.

The outer housing 50 has a first internal projection 72 extending between the caps 58. The first internal projection 72 is located near the side wall of the outer housing 50, remote from the connection portion 52. The first internal projection 72 is cylindrical, with its axis parallel to the axis of the bearing 56. It is located at about 45° above a midline of the bearing 56.

The body portion 60 includes a catch 74. The catch 74 is generally parallel to the bore 62, and is located on a side of the bore 62 away from the connection portion 52. The catch 74 has an internal end having a hook 76 and an external end being a release arm 78 which extends through the side wall of the outer housing 50.

Figure 6:
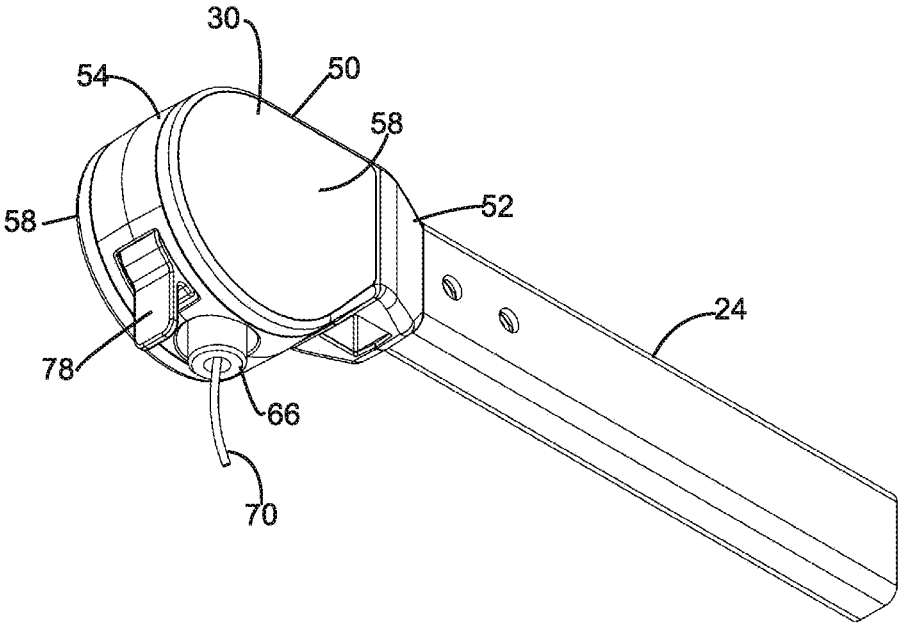
FIG. 6 is a perspective of an arm mounting from within the patient transport chair of FIG. 1.
Figure 7:
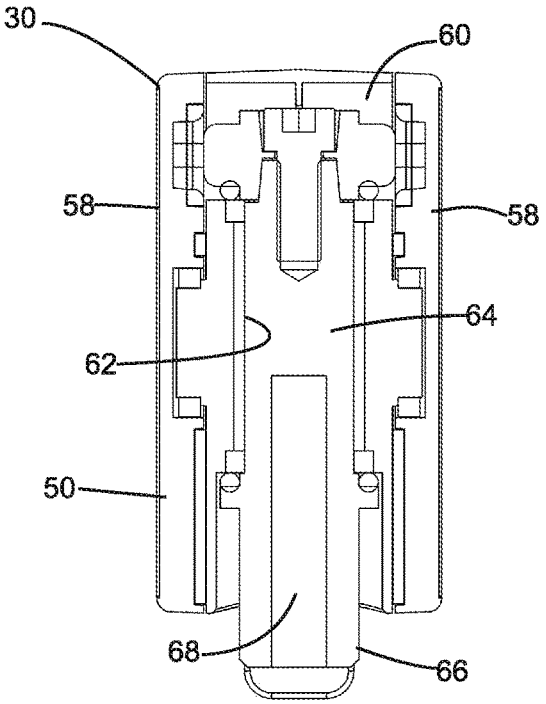
FIG. 7 is a cross section through an end of the arm mounting of FIG. 6.
Figure 8:
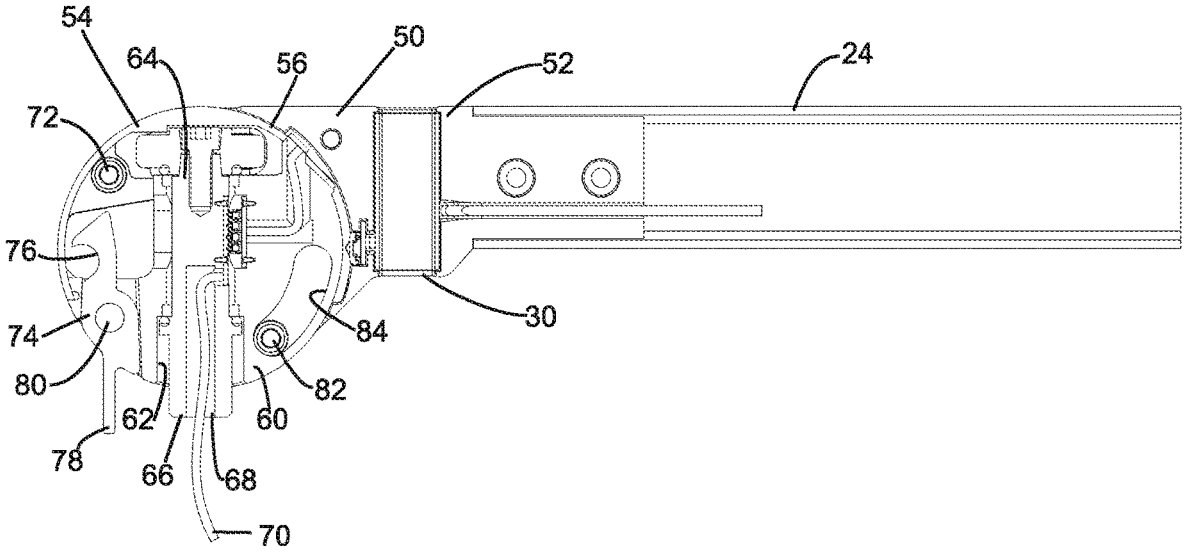
FIG. 8 is a cross section through a side of the arm mounting of FIG. 6.

The arrangement is such that the body portion 60 is able to rotate through about 45° within the bearing 56 from a lowered position shown in FIGS. 6 to 8, with the outer projection 66 pointing downwards, to a raised position. In the raised position the hook 76 engages with and locks around the first internal projection 72 so as to maintain the body portion 60 in the raised position. The catch 74 has a central pivot 80, such that rotation of the release arm 78 about the pivot 80 causes the hook 76 to disengage the first internal projection 72, permitting rotation of the body portion 60 back to the lowered position.

The outer housing 50 has a second internal projection 82 extending between the caps 58. The second internal projection 82 is located about two thirds of the way from the central axis of the bearing 56 to the side wall of the outer housing 50, approximately opposite the first internal projection 72. The second internal projection 82 is cylindrical, with its axis parallel to the axis of the bearing 56.

The body portion 60 includes an arcuate slot 84 which extends through about 45°, and is arranged to locate about the second internal projection 82. The arrangement is such that when the body portion 60 is in the lowered position the second internal projection 82 abuts one end of the acuate slot 84, and when the body portion 60 is in the raised position the second internal projection 82 abuts the other end of the arcuate slot 84.

Operation of the patient transport chair 10 will now be described.

FIG. 1 shows the patient transport chair 10 in a position whereby the first arm 34 and the second arm 36 are both in a first operative position, with the inner portions 38 and extension portions 40 of each arm being perpendicular to the transverse direction, and each forming an angle of about 45° relative to the elongate direction. The handles 42 are directed in the transverse direction, and are parallel to each other.

In this position the body portions 60 of the arm mountings 30, 32 are each locked in their raised positions, with the rotating shafts 64 rotated within their bores 62 so as to orient the extension portions 40 in the desired position.

It will be appreciated that in this position the handles 42 are located well to the rear of the patient transport chair 10. In particular, the backrest 20 can be moved between an upright position and a reclined position, even to a fully reclined position, without interference from the arms 34, 36. Any force applied to the handles 42, for instance by an orderly, is transferred through the arm mountings 30, 32 to the side rails 24, 26 and thence to the frame 14, column 22 and wheeled undercarriage 12. No part of this force passes through the patient carrying portion.

Figure 2:
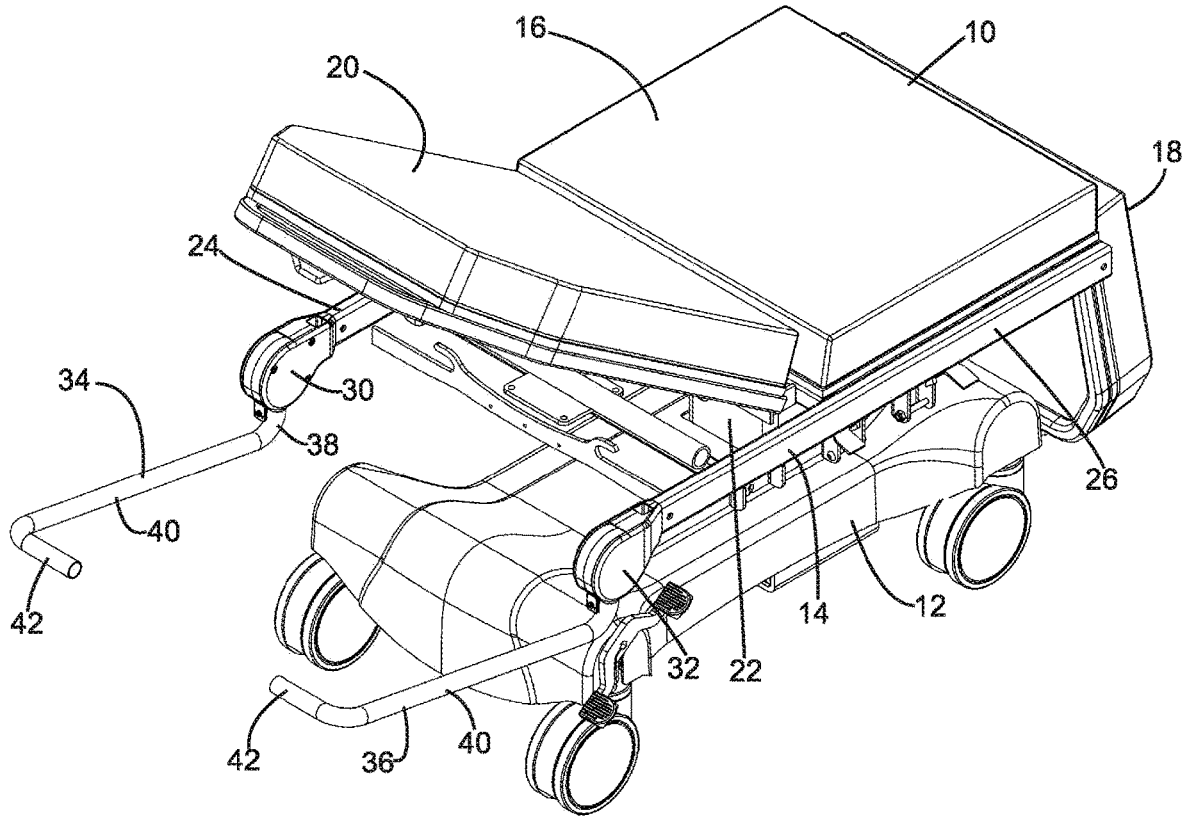
FIG. 2 is a perspective of the patient transport chair of FIG. 1, with the two arms each in a second operative position.

FIG. 2 shows the patient transport chair 10 in a position whereby the first arm 34 and the second arm 36 are both in a second operative position, with the first arm 34 and the second arm 36 having been rotated about their first axis into positions whereby the extension portions 40 are generally parallel to the respective side rails 24, 26. It will be appreciated that movement to this second operative position requires release of the catches 74, and rotation of the body portions 60 to their lowered positions.

As in the position of FIG. 1, when the patient transport chair 10 is in the position of FIG. 2, the backrest 20 can be moved between an upright position and a reclined position, even to a fully reclined position, without interference from the arms 34, 36. Additionally, any force applied to the handles 42 is transferred to the wheeled undercarriage 12 without passing through the patient carrying portion.

Figure 3:
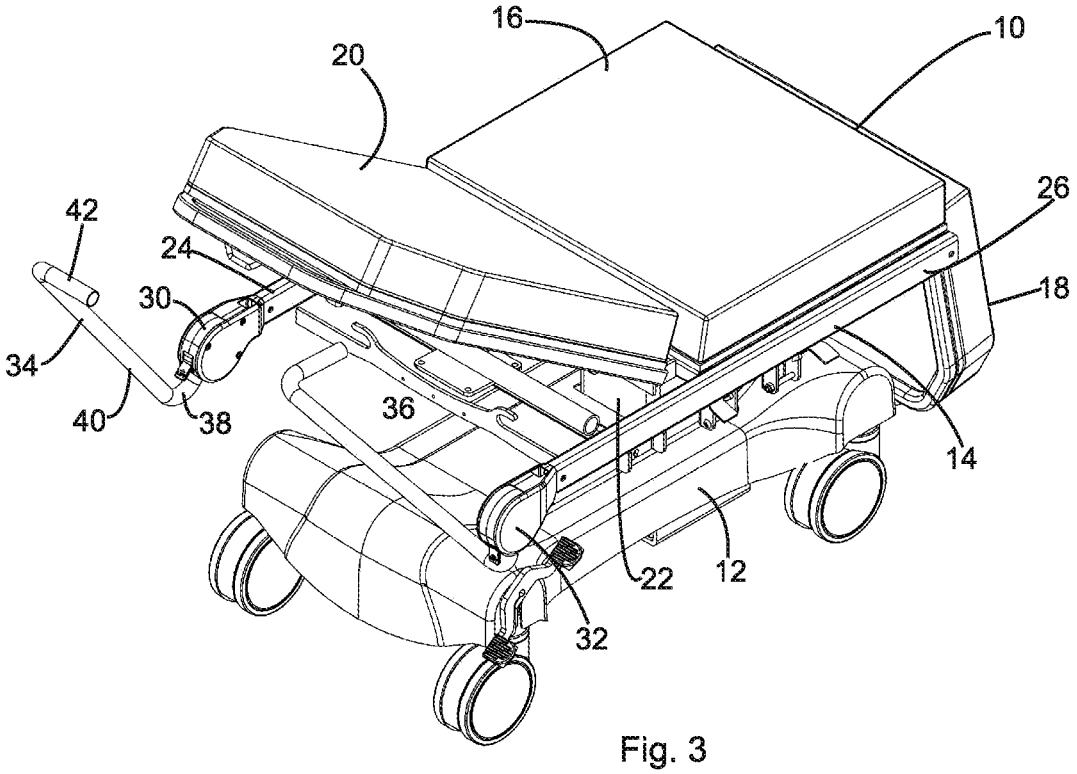
FIG. 3 is a perspective of the patient transport chair of FIG. 1, showing one arm in a stowed position and one arm in a first operative position.

FIG. 3 shows the patient transport chair 10 in a position whereby the first arm 34 has been returned to its first operative position, and the second arm 36 has been moved into a stowed position. The stowed position is achieved by rotation of the inner portion 38 of the second arm 36 about its axis (that is, rotation of the shaft 64 within the bore 62) until the extension portion 40 locates generally in the transverse direction. In this position, the second arm 36 locates directly beneath the backrest 20, notably in a position lower than even a fully reclined backrest 20.

Figure 4:
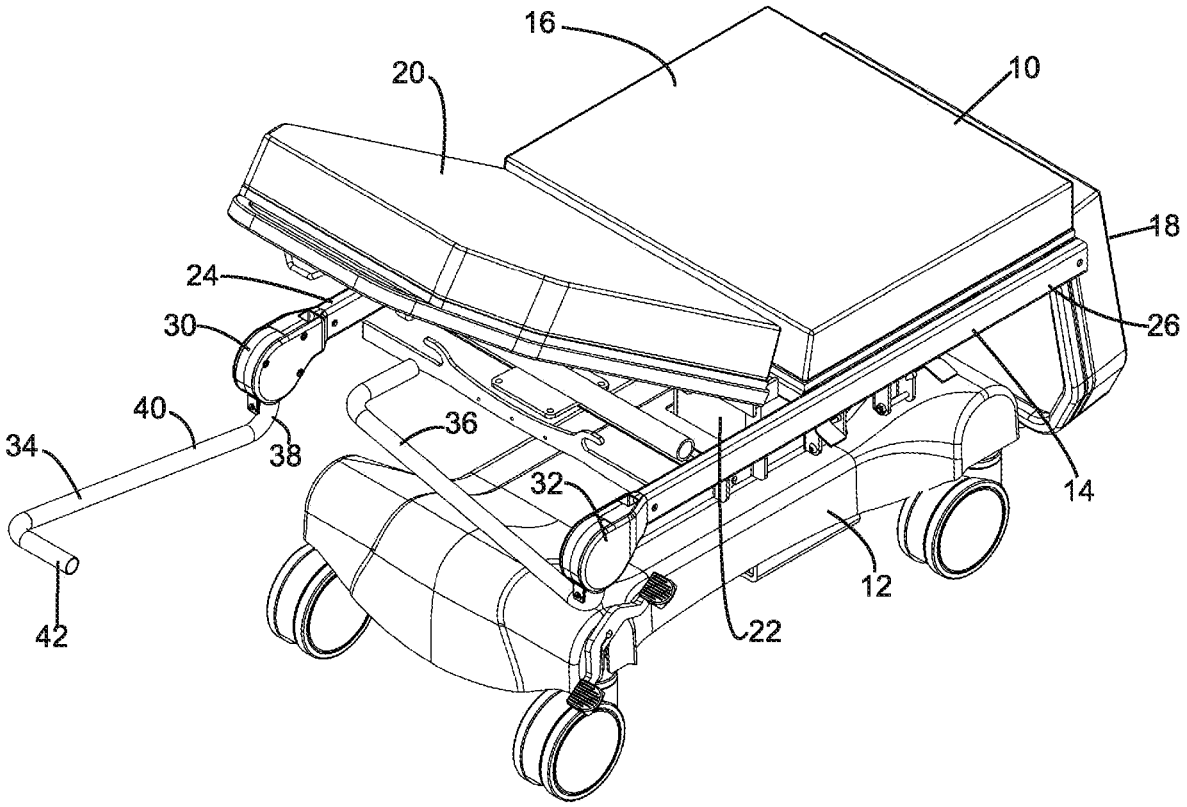
FIG. 4 is a perspective of the patient transport chair of FIG. 1, showing one arm in a stowed position and one arm in a second operative position.

FIG. 4 shows the patient transport chair 10 in a position whereby the first arm 34 is in its second operative position and the second arm 36 is in its stowed position.

Figure 5:
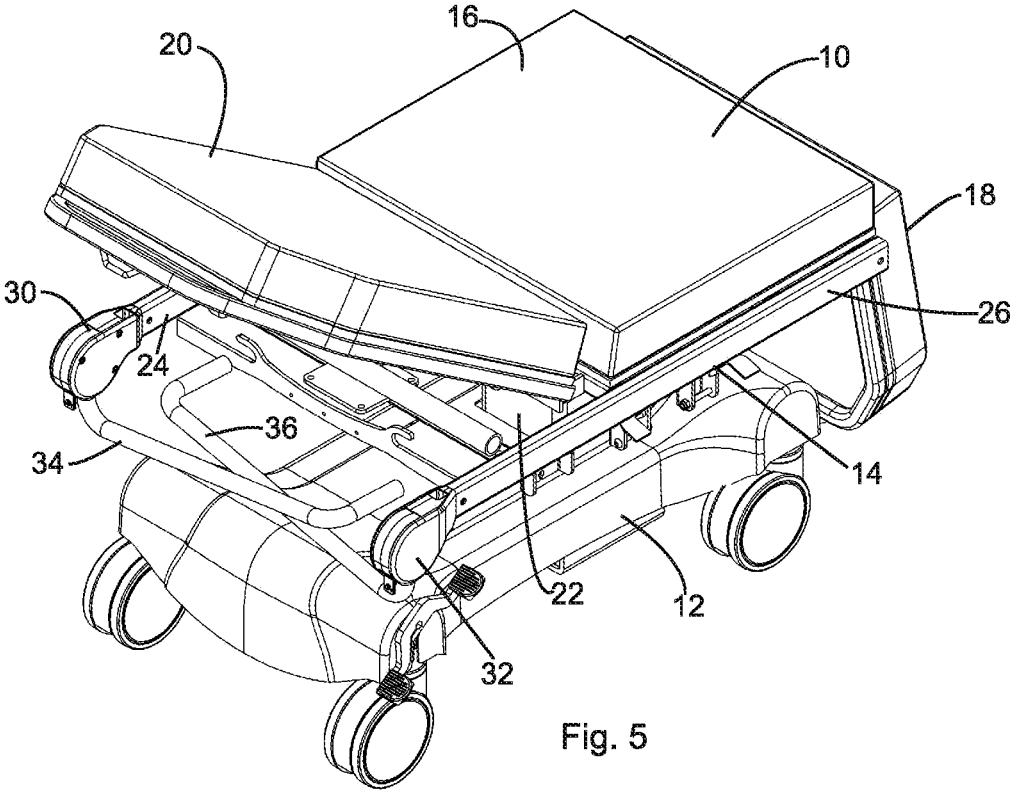
FIG. 5 is a perspective of the patient transport chair of FIG. 1, showing both arms in a stowed position.

FIG. 5 shows the patient transport chair 10 with both arms 34, 36 in stowed positions.

It will be apparent that no matter what the position of the backrest 20 each arm 34, 36 can be independently moved between its first and second operative positions and its stowed position without affecting a patient. Similarly, it will be apparent that no matter what the position of the arms 34, 36, the backrest 20 can be raised and lowered as desired without interference.

Modifications and variations as would be apparent to a skilled addressee are deemed to be within the scope of the present invention.

The invention claimed is:

1. A patient conveyance apparatus having a frame, the patient conveyance apparatus having an elongate direction and a transverse direction;

the frame supporting a patient carrying portion, the patient carrying portion comprising a backrest which is moveable between a generally upright raised position and a relatively reclined lowered position;

the frame including a first arm mounting from which a first arm extends and a second arm mounting from which a second arm extends, each of the first arm and the second arm having an outer handle;

each of the first arm and the second arm being movable relative to the frame about a first axis and about a second axis, the first axis being oriented in the transverse direction, the second axis being generally perpendicular to the first axis, each of the first arm and the second arm being moveable between a stowed position in which the arm is located beneath the backrest and an operative position in which the arm extends to the rear of the backrest, each of the first arm and the second arm being moveable between its stowed position and its operative position when the backrest is in either its raised position or its lowered position.

2. A patient conveyance apparatus as claimed in claim 1, wherein each arm mounting comprises a locking mechanism arranged to move between a locked configuration whereby the arm is fixed in a desired operative position and an unlocked configuration whereby the arm is free to move.

3. A patient conveyance apparatus as claimed in claim 1, wherein movement of each arm is restricted by friction within the respective arm mounting.

4. A patient conveyance apparatus as claimed in claim 1, wherein each arm is located outside the backrest when in its operative position, whereby the backrest can be moved between its upright position and its lowered position while the arms are in their operative position.

5. A patient conveyance apparatus as claimed claim 1, wherein each arm mounting comprises a housing which defines a substantially cylindrical bearing having an axis oriented in the transverse direction, and an internal arm support arranged to rotate within the housing.

6. A patient conveyance apparatus as claimed in claim 5, wherein the housing comprises a first internal projection, with the internal arm support having a catch arranged to engage with the internal projection when the arm is in its operative position.

7. A patient conveyance apparatus as claimed in claim 6, wherein the catch includes a release arm which extends, in use, outside the housing.

8. A patient conveyance apparatus as claimed in claim 5, wherein the housing comprises a second internal projection, with the internal arm support having an arcuate slot arranged to locate about the second internal projection, the second internal projection arranged to limit rotation of the internal arm support relative to the housing.

9. A patient conveyance apparatus as claimed in claim 8, wherein the arcuate slot extends through about 45°.

10. A patient conveyance apparatus as claimed in claim 5, wherein the internal arm support comprises an outer projection to which an arm is mounted.

11. A patient conveyance apparatus as claimed in claim 10, wherein the outer projection is located on an internal shaft, arranged to rotate relative to the internal arm support about an axis perpendicular to the axis of the housing.

12. A patient transport chair being a patient conveyance apparatus as claimed in claim 1, wherein the conveyance apparatus is configured as a patient transport chair.

13. A stretcher being a patient conveyance apparatus as claimed in claim 1, wherein the conveyance apparatus is configured as a stretcher.

* * * * *